United States Patent [19]

Wright

[11] 4,015,578

[45] Apr. 5, 1977

[54] BALL THROWING APPARATUS

[76] Inventor: Donald W. Wright, 911 Old Orchard Road, Campbell, Calif. 95008

[22] Filed: Apr. 27, 1973

[21] Appl. No.: 355,152

[52] U.S. Cl. ..... 124/7; 124/50; 124/41 R; 124/36; 124/80; 280/43

[51] Int. Cl.[2] ..... F41B 3/04

[58] Field of Search ..... 124/7, 6, 36, 41, 50, 124/49, 17, 16; 280/43; 273/29 A, 26 D

[56] References Cited

UNITED STATES PATENTS

| | | | |
|---|---|---|---|
| 1,295,069 | 2/1919 | Rouen | 124/7 |
| 1,912,360 | 6/1973 | Blanchard | 124/7 |
| 2,057,599 | 10/1936 | Serrano | 124/17 UX |
| 2,767,985 | 10/1956 | Maxcey et al. | 124/7 X |
| 2,836,430 | 5/1958 | Langenbacher | 280/43 |
| 2,878,801 | 3/1959 | Patchin et al. | 124/7 |
| 2,908,266 | 10/1959 | Cooper | 124/6 |
| 3,470,859 | 10/1969 | Ponza | 124/7 |
| 3,695,247 | 10/1972 | Tucker et al. | 124/17 |

*Primary Examiner*—Richard C. Pinkham
*Assistant Examiner*—William R. Browne
*Attorney, Agent, or Firm*—Jack M. Wiseman

[57] ABSTRACT

A portable, self-contained tennis ball throwing apparatus is disclosed which includes a constantly rotating cam having gradually increasing radii of successive points around its periphery and an abrupt transition from a maximum radius to a minimum radius, a pivotally mounted throwing arm having one end biased into contact with the periphery of the cam and supporting a ball receiving cup at its other end, and a resilient member for biasing the throwing arm, such that the cam effectively cocks the throwing arm at a relatively slow rate and releases the throwing arm to move under the influence of the resilient member to impart a throwing force to a tennis ball. The housing of the apparatus is mounted on a carriage which is movable with respect to the housing to change the pitch angle thereof, and, therefore, the angle of trajectory of a thrown ball. The ball receiving cup is also adjustable to change the angle of trajectory of the thrown ball. An adjustable anchoring arm is provided for the resilient member and permits adjustment of the tension applied to the throwing arm. A gravity feed ball hopper feeds a ball release mechanism which is actuated by the throwing arm once during each throwing cycle to release one ball at a time onto the ball receiving cup.

6 Claims, 8 Drawing Figures

FIG. 3
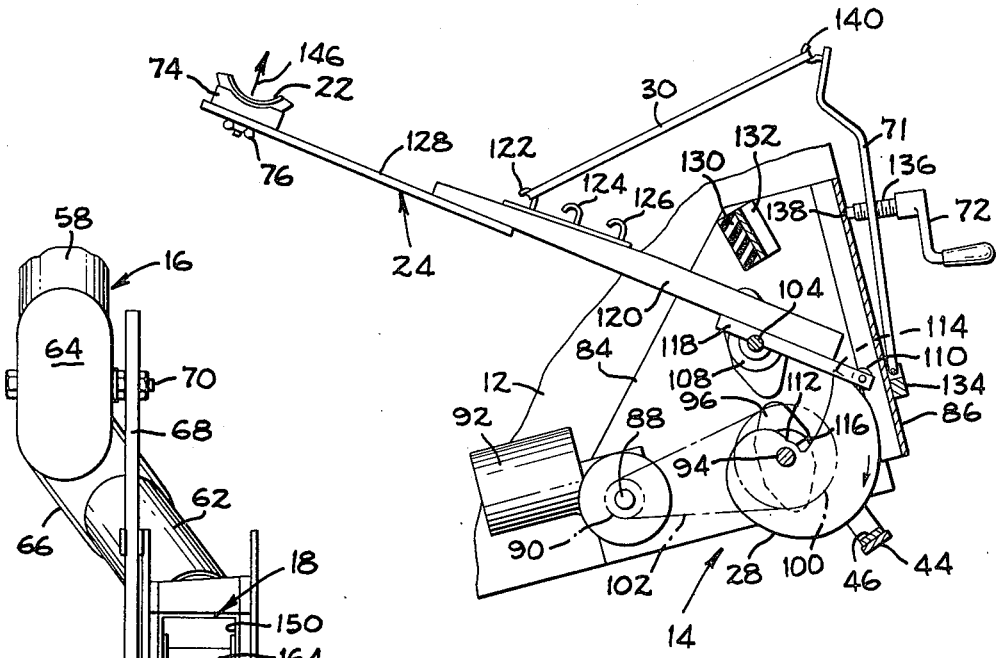
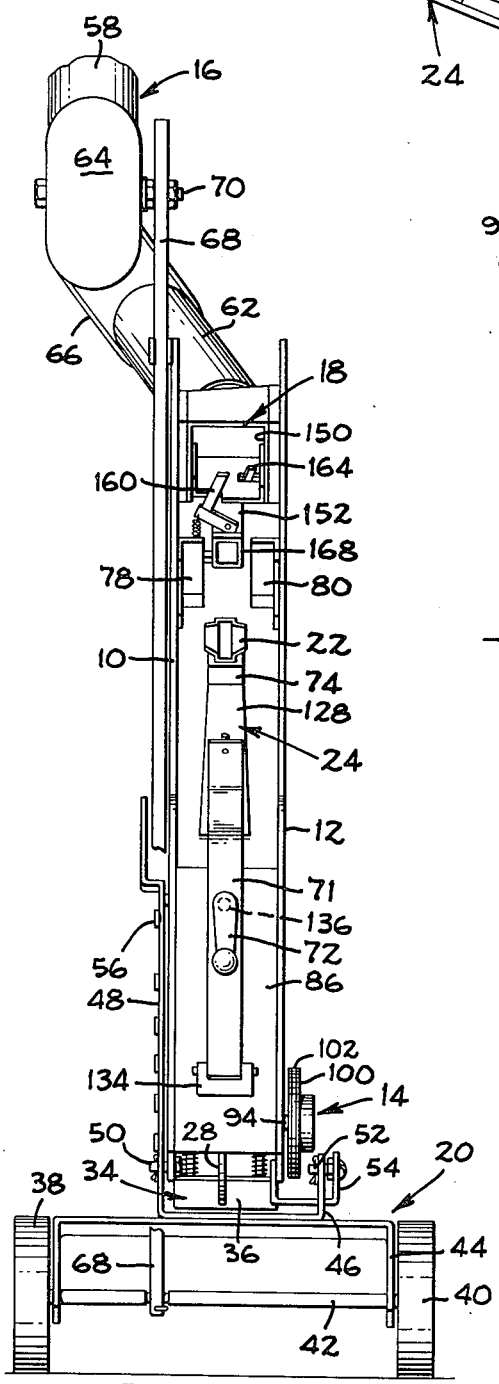
FIG. 2
FIG. 4
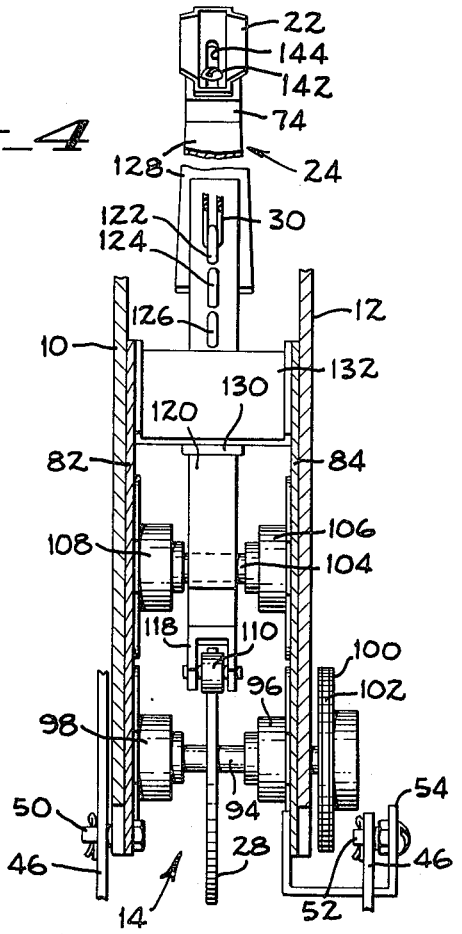

Fig_5
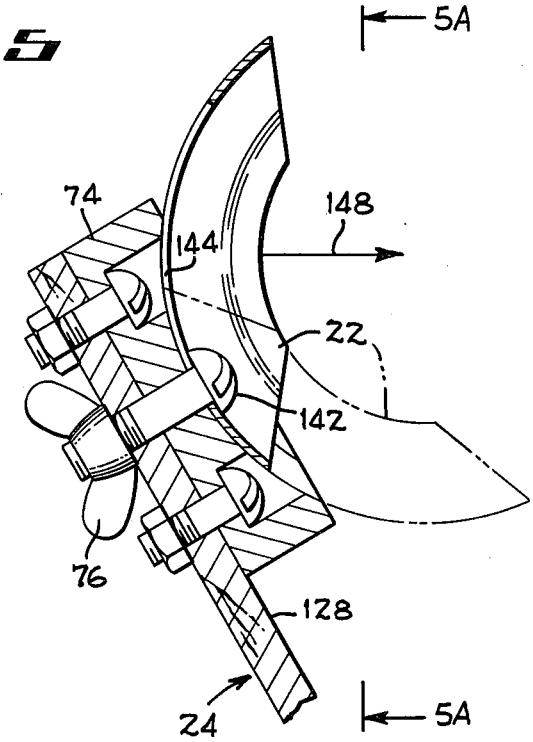
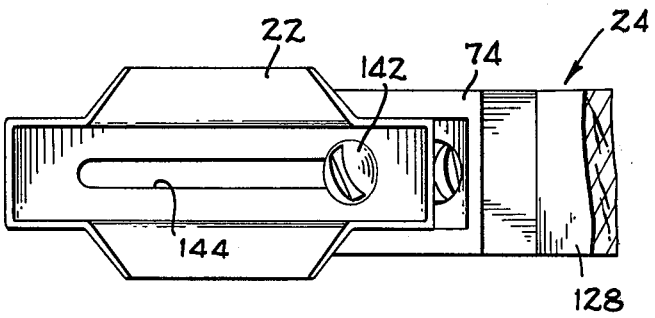
Fig_5A

BALL THROWING APPARATUS

BACKGROUND OF THE INVENTION

This invention relates generally to a projectile throwing apparatus and more particularly to a portable, self-contained apparatus for throwing tennis balls and the like.

Apparatus for throwing tennis balls, baseballs, and the like projectiles are employed extensively for training purposes. For example, a tennis ball throwing device can be positioned on a tennis court to automatically propel a tennis ball over the net and thereby simulate actual tennis play. A number of tennis ball throwing devices are presently available on the market. Although such devices perform satisfactorily, they do not provide all of the features which may be desired by the user.

The majority of the presently available throwing devices are not sufficiently portable to be moved from place to place by one individual. Some of those devices must be permanently installed at a particular site, while others, because of their excessive weight, require the use of a dolly to transport them from one site to another.

Another disadvantage of some of the prior known throwing devices is that they require a relatively large source of power. Such a requirement, of course, dictates an increase in the weight of the unit and, therefore, contributes to the nonportability of the device.

Another problem associated with some of the prior known throwing devices is that of providing repetitive, consistent performance. That is, a particular ball throwing device may not be capable of throwing the ball along the same trajectory in successive cycles of operation. Furthermore, many of the presently available throwing devices do not provide the degree of adjustability which is desired for achieving a variety of trajectories or for altering the time period between successive throwing cycles.

One particular tennis ball throwing device which is available on the market employs a ball throwing arm which rotates 360° for each successive throwing cycle. Such a device requires a dwell mechanism to permit the time between successive throws to be within desired and accepted limits. Such a dwell mechanism adds considerably to the cost of the device and generally increases the power requirement thereof.

Another ball throwing device which is presently available on the market employs compressed gasses or air for generating the necessary force required to propel the ball into the desired trajectory. It can be readily appreciated that the use of compressed gas or air is not the most efficient method for imparting a force to a ball. A device which employs compressed gas or air to supply the necessary force to the ball requires the use of a pressurized container which must be periodically recharged. Such containers are relatively heavy, thereby adding to the total weight of the device to reduce its portability. Variation in ball diameters greatly influences the amount of pressure required to release a ball and, therefore, is subject to greater inconsistency.

SUMMARY OF THE INVENTION

Accordingly, it is an object of the present invention to provide a ball throwing apparatus which has a relatively high efficiency, thereby requiring less motive power input in relation to the output achieved.

Another object of the present invention is to provide a ball throwing apparatus which is completely portable and self-contained.

Still another object of the present invention is to provide a ball throwing apparatus having a relatively high degree of reliability.

A further object of the present invention is to provide a ball throwing apparatus which can effectively simulate the action of a human being in throwing a ball to cause it to follow a desired trajectory.

These and other objects of the present invention are attached by a ball throwing apparatus which employs a constantly rotating cam for cocking and releasing a ball throwing arm. A ball loading mechanism is actuated by the ball throwing arm and deposits one ball at the throwing position during each throwing cycle. A cup is provided at one end of the ball throwing arm to receive the ball, and such cup is adjustable to alter the trajectory of the released ball.

A feature of the present invention resides in the provision of means for altering the amount of force which is applied to each thrown ball.

Another feature of the present invention resides in the provision of means for altering the aspect or pitch angle of the throwing mechanism to alter the trajectory path of the thrown ball.

These and other objects, features and advantages of the present invention, however, will be more fully realized and understood from the following detailed description, when taken in conjunction with the accompanying drawings, wherein:

BRIEF DESCRIPTION OF THE DRAWING

FIG. 2 is a front elevational view, also partially broken away, taken along lines 2—2 of FIG. 1, of the tennis ball throwing apparatus illustrated in FIG. 1;

FIG. 3 is a side view, partially broken away and partially in section, of the drive and cam assembly employed in the tennis ball throwing apparatus of the present invention;

FIG. 4 is a front view, partially broken away and partially in section, of the drive and cam assembly illustrated in FIG. 3, with the end panel removed;

FIG. 5 is a broken out side view of the ball retaining cup illustrated in FIGS. 3 and 4, but with the cup located in a different position;

FIG. 5A is a view taken along lines 5A—5A of FIG. 5;

Like reference numerals throughout the various views of the drawings are intended to designate the same elements.

DETAILED DESCRIPTION OF THE PREFERRED EMBODIMENT

Figure 1:
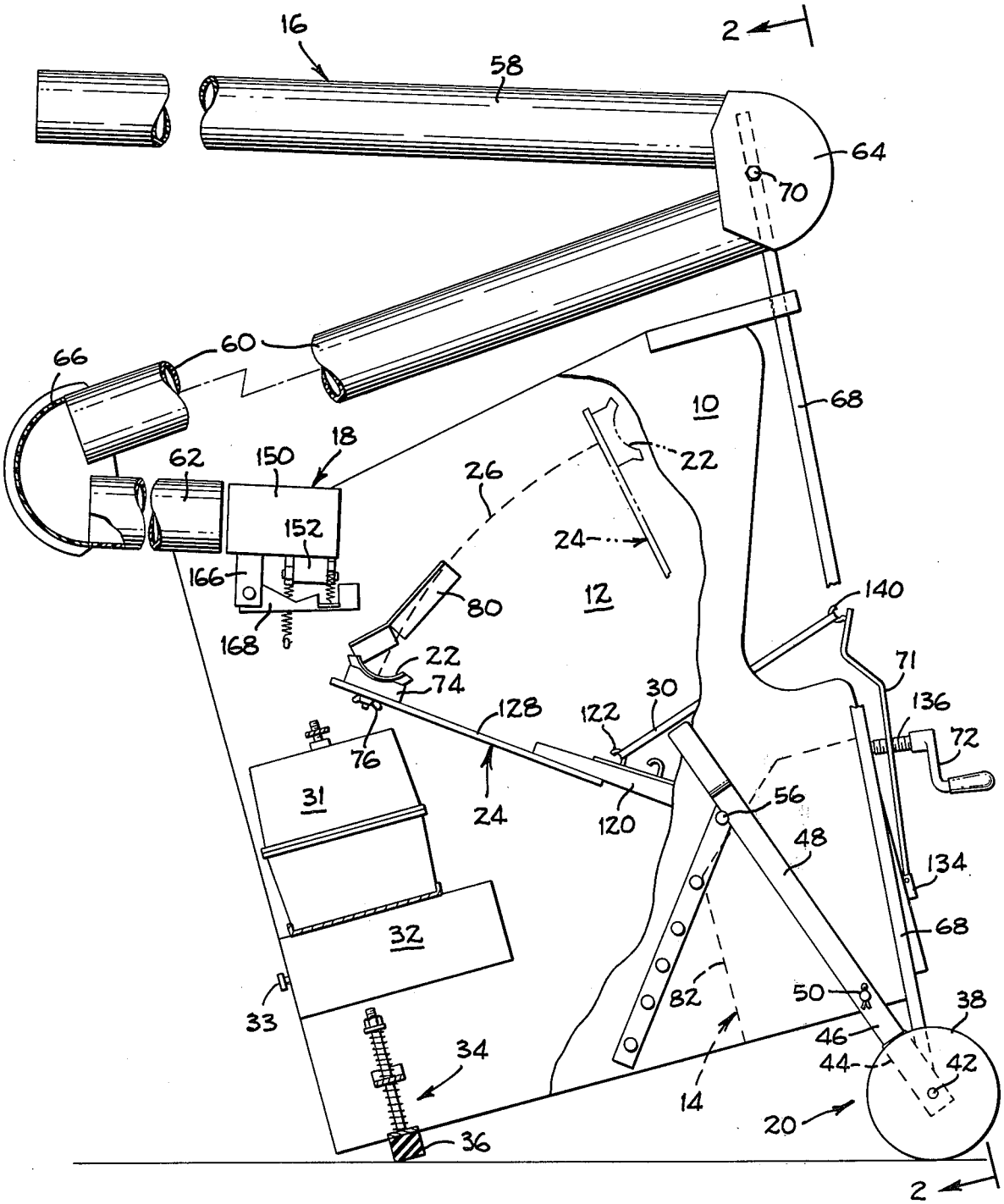
FIG. 1 is a side elevational view, partially broken away, of a tennis ball throwing apparatus constructed in accordance with the principles of the present invention.

With particular reference to FIGS. 1, 2, and 3, there is shown a tennis ball throwing apparatus constructed in accordance with the principles of the present invention. The disclosed tennis ball throwing apparatus includes a housing which is formed by a pair of walls 10 and 12 spaced from one another, a drive and cam assembly 14 mounted within the housing, a gravity feed ball hopper 16 supported over the housing, and a ball release assembly 18 mounted within the housing at a lower end of the hopper 16. In addition, the tennis ball throwing apparatus is provided with a carriage assembly 20 which is adjustable to alter the elevation of front end of the apparatus. Briefly, balls are supplied from the hopper 16 to the ball release assembly 18, which deposits one ball at a time onto a ball receiving or retaining cup 22. An arm 24 which supports the cup 22 actuates the ball release assembly 18 during movement thereof to its lower most position to permit only one ball to be deposited on the cup 22. The arm 24 is translated along a path represented by the dotted line outline indicated with the reference numeral 26 by a cam 28 (FIG. 3) which is part of the drive and cam assembly 14. The arm is biased toward its upper limit by a resilient member 30 to throw a ball along a desired trajectory.

A battery 31 is mounted within the housing and supplies power to the drive and cam assembly 14 through a variable resistor and control circuit 32. The rotational speed of the cam 28 is regulated by the variable resistor and control circuit 32 and can be manually adjusted as represented by a knob 33 to rotate at any desired speed. Such variable resistor and control circuits are well known in the art and require no further explanation for purposes of the present disclosure.

The housing is supported at the front end thereof on the carriage assembly 20 and at the back end thereof by means of a shock absorber 34 which includes a foot pad 36. Any vibration or shock produced by movement of the arm 24 is absorbed by the shock absorber 34. In addition, the foot pad 36 is made of a material which has a high coefficient of friction with ground to reduce the amount of movement, such as creeping, of the unit during its operation.

The carriage assembly 20 includes a pair of wheels 38 and 40 mounted on a shaft 42. A U-shaped bracket 44 is mounted on the shaft 42 and supports a bracket 46 which terminates in an arm 48. The bracket 46 is rotationally supported on a pair of pins 50 and 52 which are aligned with one another. The pin 50 is secured to and extends from the wall 10 and the pin 52 is secured to and extends from a bracket 54 which is, in turn, secured to the wall 12 with the end supporting the pin 52 being spaced from the wall 12. A plurality of lugs, one of which is indicated with the reference numeral 56, are secured to the wall 10 and are disposed for receiving an edge of the handle 48 from one lug to another causes the bracket 46 to rotate about the pins 50 and 52 to change the elevation of the forward end of the apparatus, thereby altering the pitch angle thereof.

The ball hopper 16 includes an inlet tube 58, a transfer tube 60, and an outlet tube 62. An elbow 64 joins the tubes 58 and 60 and an elbow 66 joins the tubes 60 and 62. The tube 62 is pivotally mounted between the walls 10 and 12 by appropriate means (not shown) and the elbow 64 is pivotally mounted on a rod 68 by means of a pin 70 extending therethrough. The rod 68 is also pivotally mounted on the shaft 42, such that movement of the handle 48 to alter the aspect or pitch angle of the apparatus will not appreciably alter the angle of the hopper 16 with respect to horizontal.

One end of an arm 71 is mounted for rotation on the end panel of the drive and cam assembly 14 and the other end thereof supports one end of the resilient member 30. Rotation of a crank 72 angularly displaces the arm 71 from the end panel of the drive and cam assembly 14 to alter the tension applied to the arm 24 by the resilient member 30.

The ball retaining cup 22 is slidably mounted on a slide block 74 which is secured to the arm 24. As will be explained in greater detail in the description of FIGS. 3–5A, the cup 22 can be displaced along an arcuate path with respect to the block 74 and can be locked in any desired position with respect thereto by means of a wing nut 76. By altering the position of the cup 22 with respect to the block 74, the trajectory angle of the ball can be changed. Furthermore, the trajectory angle of the thrown ball can be altered by changing the position of the arm 48 to change the pitch angle of the apparatus.

In operation, a number of balls are first loaded into the hopper 16, with at least the first one rolling under the influence of gravity into the ball release mechanism 18. The appropriate angle of trajectory is selected by properly positioning the cup 22 and the carriage 20. The desired throwing force is selected by adjusting the tension on the arm 24 by means of the crank 72. Successive throwing cycles are initiated by energizing the drive for the cam 28. As the cam 28 rotates, the arm 24 is rotated toward its lowermost position, engaging the ball release mechanism near the lowermost position, thereby permitting a ball to be released and to fall onto the cup 22. A pair of angle members 78 and 80, mounted on the innersurfaces of the walls 10 and 12, respectively, serve to guide each ball which is released by the mechanism 18 onto the cup 22.

The cam 28, as will be explained in the description of FIG. 3, is provided with an abrupt transitional phase at which the arm 24 is effectively released to move under the influence of the resilient member 30 to its uppermost position. Such movement, of course, imparts a throwing force to a ball which exits from the forward end of the apparatus. Continued rotation of the cam 28 again translates the arm 24 from its uppermost position to its lowermost position to repeat the above described cycle. It can be readily appreciated that the speed of the cam 28 affects only the duration of the time period between successive throws. The force imparted to the ball and, therefore, the speed at which the ball is thrown, is determined by the amount of tension applied to the arm 24 by means of the resilient member 30.

Details of the drive and cam assembly 14, the throwing arm including the throwing arm 24 and cup 22, and the tension assembly including the arm 70 and the resilient member 30 will be better understood from FIGS. 3–5A. With reference to FIG. 3, the drive and cam assembly 14 is mounted within a housing which is formed by a pair of side walls 82 and 84 and an end panel 86. A shaft 88 extends through and is journalled in the side wall 84 and also extends through the wall 12. A sprocket or pulley 90 is mounted on the shaft 88 which, in turn, is driven through a worm gear arrangement (not shown) from a motor 92. The battery 31 (FIG. 1) supplied power to the motor 92 through a variable resistor and control circuit 32. The cam 28 is mounted on a shaft 94 which is, in turn, mounted in bearing blocks 96 and 98 secured to the walls 84 and 86, respectively and extends through the wall 84 and the wall 12. A sprocket or pulley 100 is mounted on the end of the shaft 94 and a belt 102 extends over the pulleys 90 and 100 to supply motive power to the shaft 94.

The throwing arm 24 is mounted on a shaft 104 which is journaled in an end of the arm 24 and is disposed for engaging a periphery of the cam 28. More particularly, the arm 24 is biased in a clockwise direction as viewed in FIG. 3 by the resilient member 30 (FIG. 1) to maintain the roller 110 in contact with the periphery of the cam 28. The radii of the cam 28 from the shaft 94 gradually increase in a counter-clockwise direction from the point 114 to the point 112 provides an abrupt transitional phase in the rotational movement of the cam 28. When the point 114 moves under the roller 110 by rotation of the cam 28 in a clockwise direction as viewed in FIG. 3, the arm 24 will be biased by the resilient member 30 in a direction to move the roller 110 directly from the point 114 to a surface 116 on the outer periphery of the cam 28, which surface has a radius equal to the radius of the peripheral point 112. As the cam 28 continues to rotate, the arm 24 will be gradually rotated between its two extremes of travel. Accordingly, if a plot is made of the rotational displacement of the cam 28 or elapsed time on the axis of abscissas, a saw tooth wave form will be produced.

The arm 24 is composed of three main parts; namely: a rigid channel member 118 which supports at one end thereof the roller 110 and is secured to the shaft 104; a rigid member 120 secured to the member 118 to which a relativity plurality of hooks 122, 124, 126 are attached; and a member 128 secured to an end of the member 120 and supporting the block 74 and cup 22 at one end thereof. The member 128 has much greater flexibility than the member 120, with the latter being preferably formed of oak or equivalent material and the former being formed of a strip of laminated wood, fiberglass, or equivalent material, similar to that employed in archery bows. The flexibility provided, particularly by the arm 128, effectively simulates the snap action which can be achieved by one's wrist during throwing action of the human arm.

When the roller 110 drops from the peripheral point 114 to the peripheral surface 116 of the cam 28, the resilient member 30 attached to one of the hooks 122, 124 or 126 biases the arm 24 in a clockwise direction as viewed in FIG. 3. Because of the momentum of the cup 22 and block 74, this action initially tends to bow the member 128. A bumper 130 is mounted on a bracket 132 which extends between and is secured to the walls 84 and 86 and is supported in the path of the arm 24. When the arm 24 engages the bumper 130, the momentum of the cup 22 and block 74 causes the member 128 to bow in an opposite direction and to continue beyond a straight line path. Such bowing of the member 128 increases the speed of the ball being thrown by increasing the speed of the cup 22.

As shown in FIG. 3, the arm 71 is pivotally mounted on a plate 134 which is secured to the front panel of the drive and cam assembly housing. The crank 72 is provided with a threaded shaft 137 which passes through a threaded hole in the arm 71. An end of the shaft 136 is disposed for being received in a recess 138 in the face of the end panel 86. A hook 140 is provided on the free end of the arm 71 and one end of the resilient member 30 is supported thereon. The resilient member 30 is preferably an elastic tubular material, such as a rubber tube, although it is to be understood that any resilient member or spring can be employed.

The use of a rubber tube as the resilient member 30 is preferred, since it is generally capable of stretching without deformation to four times its original length, whereas a spring is generally capable of stretching to one and one-half its original length. The member 30 extends from the hook 140 to one of the hooks 122, 124 and 126 on the arm 24. By changing from one of the hooks 122, 124, and 126 to another, the tension on the arm 24 is changed. Accordingly, coarse adjustment of the tension on the arm 24 is effected by such a change and fine adjustment is accomplished by rotating the crank 72.

As shown in FIGS. 5 and 5A, the arcuately shaped ball retaining cup 22 is disposed for being received in an arcuate slot in the block 74 which is, in turn, secured to the member 128 of the arm 24. A bolt 142 extends through a slot 144 in the cup 22 and an aperture in the block 74 and is secured by the wing nut 76. The head of the bolt 142 extends over the edges of the slot 144, such that when the bolt 142 is loosened by rotating the wing nut 76, the cup 22 can be displaced along its arcuate path with respect to the block 74. With the cup 22 in the position illustrated in FIG. 3, the angle of trajectory of the thrown ball will be along a line depicted by an arrow which is indicated with the reference numeral 146. When the cup 22 is translated to its one extreme position as is shown in FIG. 5, the angle of trajectory of the thrown ball will be along a line depicted by an arrow indicated with the reference numeral 148. When the cup 22 is translated to its opposite extreme position from that shown in FIG. 5, a similar result will be produced, with the angle of trajectory of the thrown ball being approximately normal to the cup at a midpoint thereof. Accordingly, it can be readily appreciated that the angle of trajectory of the thrown ball can be varied considerably by translating the ball retaining cup 22 along an arcuate path with respect to the block 74.

Figure 7:
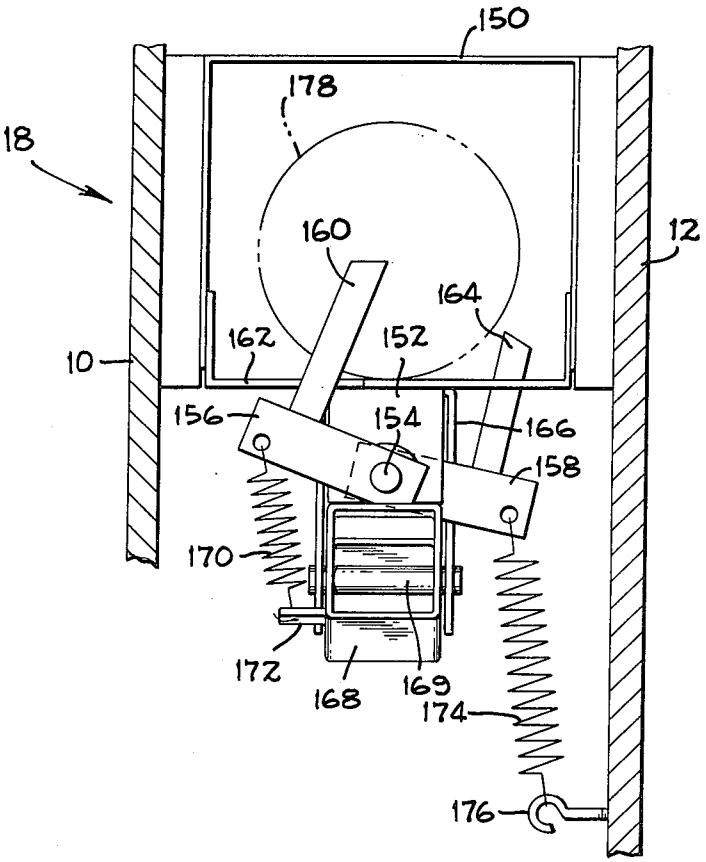
FIG. 7 is a front view of the ball release assembly illustrated in FIG. 6.
Figure 6:
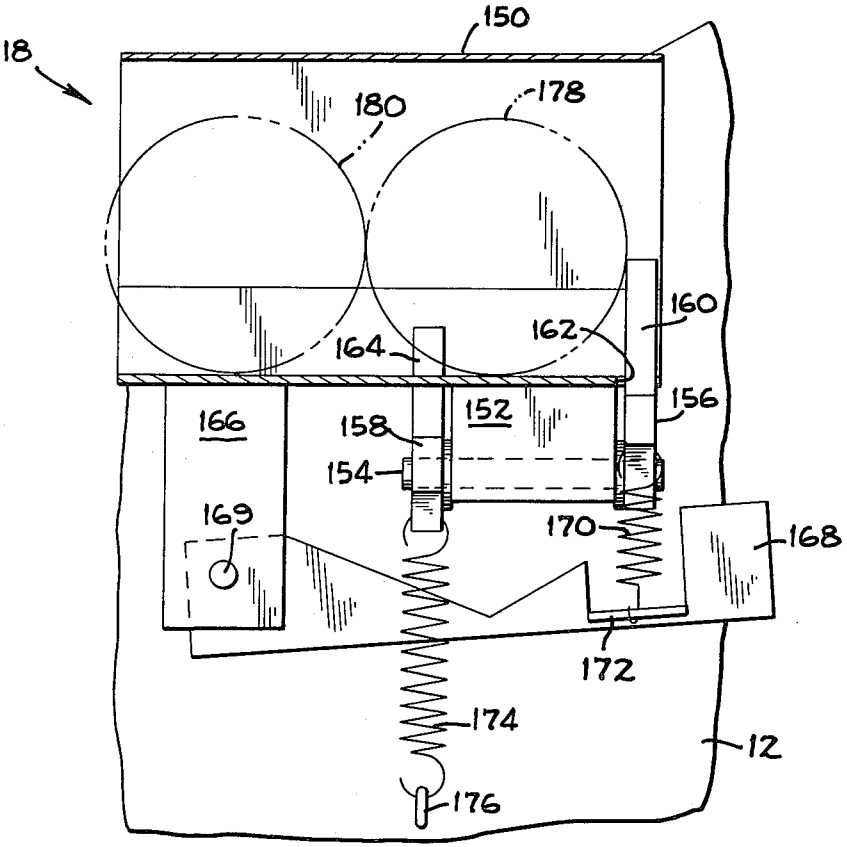
FIG. 6 is a side view, partially in section of the ball release assembly employed in the present invention.

The ball release assembly 18 is illustrated in greater detail in FIGS. 6 and 7. A shown therein, a housing 150 forms a conduit for receiving successive balls from the outlet tube 62 of the ball hopper 16. A bearing block 152 is secured to a lower wall of the housing 150 and supports a shaft 154 extending therethrough for rotation. An arm 156 is secured to one end of the shaft 154 and an arm 158 is secured to the other end thereof. A finger member 160 extends from the arm 156 and through a slot 162 in the housing 150. A finger member 164 extends from the arm 158 through an appropriate slot in the lower wall of the housing 150. The arms 156 and 158 are pinned to the shaft 154, and therefore, rotate together. A support bracket 166 is secured to the lower wall of the housing 150 and pivotally supports one end of a trigger bar 168 by means of a shaft 169 passing therethrough. As viewed in FIG. 7, the arm 156 is biased in a counterclockwise direction by means of a spring 170 which extends from the arm 156 to a tab 172 which is part of the trigger bar 168. Also as viewed in FIG. 7, the arm 158 is biased in a clockwise direction by means of a spring 174 which extends from the arm 158 to a hook 176 secured to the wall 12.

Without any force applied to the trigger bar 168 to cause it to rotate in a clockwise direction around the shaft 169 as viewed in FIG. 6, it will be raised to its illustrated position by the action of the spring 174 rotating the shaft 154 in a clockwise direction as viewed in FIG. 7 and lifting the free end of the trigger bar 168 by means of the spring 170. However, when the throwing arm 24 is moving toward its lower-most position, it contacts the free end of the trigger bar 168 and rotates it in a clockwise direction around the shaft 169 as viewed in FIG. 6. Such rotation of the trigger bar 168 causes the arm 156 to rotate in a counterclockwise direction as viewed in FIG. 7, thereby removing the finger member 160 from the path of the ball located within the conduit 150. Such a ball is depicted in FIG. 6 by the dotted line outline indicated with the reference numeral 178. An adjacent ball is indicated by the dotted line outline indicated with the reference numeral 180. With the arms 156 and 158 in the position shown in FIG. 7, the finger member 160 impedes the movement of a ball passed and out of the end of the conduit 150. When the ball release mechanism is mounted within the housing of the ball throwing apparatus, the conduit 150 is tilted with respect to horizontal, such that a ball placed therein will roll down to and bear against the finger member 160 under the influence of gravity. When the finger member 160 is rotated out of the path of travel of such a ball, the finger member 164 is rotated into the path of travel of an adjacent ball. Accordingly, only one ball will be released onto the ball retaining cup 22 during each throwing cycle. When the arm 24 is released to throw such a ball, the trigger bar 168 is released to rotate the shaft 154 in a clockwise direction as viewed in FIG. 7 to permit the finger members 160 and 164 to resume their positions as illustrated in FIG. 7. Accordingly, the ball which had been restrained by the finger member 164 is released and permitted to roll down to bear against the finger member 160. Accordingly, it can be readily appreciated that the ball release assembly 18 is effectively an escapement mechanism which permits one ball at a time to be released during each throwing cycle.

The tubes 58, 60 and 62 and the elbows 64 and 66 of the ball hopper 16 are preferably formed of a plastic material and are, therefore, of relatively light weight. Furthermore, the ends of the respective tubes and the inner surfaces of the respective elbows can be formed with mating locking surfaces which are releasable from one another to permit disassembly of the ball hopper 16. The bar 68 which supports the elbow 64 is provided with a U-shaped slot in its lowermost end for receiving the shaft 42 and, therefore, can be readily removed from the shaft 42. In addition, appropriate means can be provided for releasably attaching an end of the outlet tube 62 to the walls 10 and 12 while permitting relative rotation therebetween.

If a retaining key is employed on the pin 50, for example, to hold the bracket 46 thereon, its removal will permit the carriage assembly 20 to be removed and stored. In one constructed embodiment of the present invention, the relative dimensions of the walls 10 and 12 were approximately 26 inches along the base by 30 inches in height and the width of the apparatus between the walls 10 and 12 was approximately four and one-half inches. Accordingly, it can be readily appreciated that the apparatus of the present invention can be quickly and easily assembled and disassembled, easily moved from one place to another, and can be stored in a relatively small space. Furthermore, because of the relatively light weight material employed, the entire device is relatively light weight for ease of portability and storage.

The carriage assembly 20 provides two distinctive features, namely: portability and pitch angle control. Such control, as previously mentioned, permits alteration of the angle of trajectory of the thrown ball. The angle of trajectory can also be controlled or altered by changing the relative position of the ball retaining cup 22 with respect to the block 74.

The flexible throwing arm 24 effectively simulates the throwing action of the wrist movement of a human arm when throwing an object. The use of such a flexible arm permits a relatively small angle of arcuate movement along the path 24 during each throwing cycle. In a contructed embodiment of the present invention, the angle traversed by the flexible throwing arm 24 was approximately 45°.

As previously mentioned, the tension on the throwing arm 24 can be changed by changing the anchor point of one end of the resilient member 30 on the arm 24. The tension can also be adjusted by rotating the crank 72. By controlling the speed of the motor 92, the rotational speed of the cam 28 can be controlled to determine the time between successive throws.

I claim:

1. A ball-throwing apparatus comprising:

a. a flexible arm mounted for pivotal movement;

b. ball-receiving means mounted on one end of said arm;

c. means for biasing said arm along an arcuate path in one direction; and d. means for translating the movement of said arm along said arcuate path in a direction opposite to said one direction and for releasing said arm at one extreme point along said arcuate path to permit said arm to move under the influence of said biasing means to the other extreme point of said arcuate path, e. said ball-receiving means including a slide member having an arcuate surface, a cup having an arcuate shape with one surface conforming to the contour of the arcuate surface of said slide member, and releasable locking means joining said cup with said slide member at various peripheral positions of said cup, whereby said cup can be releasably locked in one of a plurality of peripheral positions with respect to said slide member to alter the angle trajectory of a thrown ball.

2. A ball-throwing apparatus comprising:

a. a flexible arm mounted for pivotal movement;

b. ball-receiving means mounted on one end of said arm;

c. means for biasing said arm along an arcuate path in one direction;

d. means for translating the movement of said arm along said arcuate path in a direction opposite to said one direction and for releasing said arm at one extreme point along said arcuate path to permit said arm to move under the influence of said biasing means to the other extreme point of said arcuate path;

e. a housing for supporting said arm, said biasing means and said translating means; and f. a carriage assembly including a shaft, a pair of wheels mounted on said shaft, and means for mounting said shaft in spaced relationship to an edge of said housing and for pivotal movement around a pivotal axis parallel to the axis of said shaft, whereby said edge of said housing can be elevated with respect to ground level.

3. A ball throwing apparatus comprising:

a. a flexible arm mounted for pivotal movement;

b. ball receiving means mounted on one end of said arm;

c. means for biasing said arm along an arcuate path in one direction;

d. means for translating the movement of said arm along said arcuate path in a direction opposite to said one direction and for releasing said arm at one extreme point along said arcuate path to permit said arm to move under the influence of said biasing means to the other extreme point of said arcute path;

e. a housing for supporting said arm, said biasing means and said translating means;

f. a carriage assembly including a shaft, a pair of wheels mounted on said shaft; and g. means for mounting said shaft in spaced relationship to an edge of said housing and for pivotal movement around a pivotal axis parallel to the axis of said shaft, whereby said edge of said housing can be elevated with respect to ground level, said mounting means including a handle for manually rotating said shaft around said pivotal axis, and means for holding said handle in one of a plurality of positions with respect to said housing.

4. A ball throwing apparatus as defined in claim 3 wherein said arm is mounted for pivotal movement around an axis parallel to said pivoted axis.

5. A ball throwing apparatus comprising:

a. an arm mounted for pivotal movement;

b. ball receiving means mounted on one end of said arm;

c. means for biasing said arm along an arcuate path in one direction; and d. means for translating the movement of said arm along said arcuate path in a direction opposite to said one direction and for releasing said arm at one extreme point along said arcuate path to permit said arm to move under the influence of said biasing means to the other extreme point of said arcuate path, e. said ball receiving means including a slide block member mounted on said arm and having an arcuate surface, a cup having an arcuate shape with one surface thereof conforming to the contour of the arcuate surface of said slide member, and releasable locking means joining said cup with said slide block member, there being relative peripheral movement between said cup and said slide block member, when said releasable locking means is in the unlocked condition, to provide adjustable peripheral positioning of said cup member relative to said slide block member, said cup being locked in one of a plurality of positions with respect to said slide block member to alter the angle of trajectory of a thrown ball.

6. A ball throwing apparatus comprising:

a. an arm mounted for pivotal movement;

b. ball receiving means mounted on one end of said arm;

c. means for biasing said arm along an arcuate path in one direction;

d. means for translating the movement of said arm along said arcuate path in a direction opposite to said one direction and for releasing said arm at one extreme point along said arcuate path to permit said arm to move under the influence of said biasing means to the other extreme point of said arcuate path;

e. a housing for supporting said arm, aid biasing means and said translating means; and f. a carriage assembly including a shaft, a pair of wheels mounted on said shaft, and means for mounting said shaft in spaced relationship to an edge of said housing and for pivotal movement around a pivotal axis parallel to the axis of said shaft, whereby said edge of said housing can be elevated with respect to ground level, said mounting means including a handle for manually rotating said shaft around said pivotal axis, said mounting means including means for holding said handle in one of a plurality of positions with respect to said housing.

* * * * *